US008127737B2

(12) United States Patent
Gosch

(10) Patent No.: US 8,127,737 B2
(45) Date of Patent: Mar. 6, 2012

(54) UNFINISHED CYLINDER HEAD CASTING, CAST CYLINDER HEAD FOR DIESEL INTERNAL COMBUSTION ENGINES, AND PROCESS FOR PRODUCING AN UNFINISHED CYLINDER HEAD CASTING

(75) Inventor: Rolf Gosch, Thalheim (AT)

(73) Assignee: Hydro Aluminium Mandl & Berger GmbH, Linz (AT)

( * ) Notice: Subject to any disclaimer, the term of this patent is extended or adjusted under 35 U.S.C. 154(b) by 895 days.

(21) Appl. No.: 11/997,849

(22) PCT Filed: Jul. 18, 2006

(86) PCT No.: PCT/EP2006/064363

§ 371 (c)(1),
(2), (4) Date: Apr. 25, 2008

(87) PCT Pub. No.: WO2007/017349

PCT Pub. Date: Feb. 15, 2007

(65) Prior Publication Data

US 2008/0202464 A1 Aug. 28, 2008

(30) Foreign Application Priority Data

Aug. 5, 2005 (DE) ..... 10 2005 037 735

(51) Int. Cl.
*B22D 15/02* (2006.01)
*F02F 1/38* (2006.01)

(52) U.S. Cl. ..... 123/193.3; 123/193.5; 29/888.06

(58) Field of Classification Search ..... 123/193.5, 123/193.3; 29/888.06
See application file for complete search history.

(56) References Cited

U.S. PATENT DOCUMENTS

| | | | | |
|---|---|---|---|---|
| 4,157,607 | A * | 6/1979 | Ernest | 29/888.06 |
| 5,768,779 | A * | 6/1998 | Adachi | 29/888.06 |
| 6,053,141 | A * | 4/2000 | Mutterer et al. | 123/193.5 |
| 6,666,254 | B2 | 12/2003 | Voigt et al. | |

FOREIGN PATENT DOCUMENTS

| | | |
|---|---|---|
| DE | 100 14 591 | 8/2001 |
| JP | 60 228012 | 11/1985 |
| JP | 62 282763 | 12/1987 |
| JP | 2001 200753 | 7/2001 |

OTHER PUBLICATIONS

International Search Report for PCT/EP2006/064363.

* cited by examiner

*Primary Examiner* — M. McMahon
(74) *Attorney, Agent, or Firm* — Proskauer Rose LLP

(57) ABSTRACT

An unfinished cylinder head casting for producing a cylinder head for internal combustion engines powered with diesel fuel includes a sealing surface, intended for mounting in a finished state on a corresponding sealing surface of an engine block, and designed on a sealing surface section of the unfinished cylinder head casting. A thickness of the sealing surface section in a casting state exhibits a machining allowance in relation to its set thickness, obtained after a material-removing finishing of the sealing surface. The sealing surface includes a combustion chamber region, associated with a combustion chamber formed in the engine block. In the case of such a cylinder head, an optimum load-bearing capacity is achieved in a simple manner in that a combustion chamber region sealing surface section machining allowance amounts to a maximum of 15% of the machining allowance of the sealing surface section in the remaining region of the sealing surface.

7 Claims, 2 Drawing Sheets

UNFINISHED CYLINDER HEAD CASTING, CAST CYLINDER HEAD FOR DIESEL INTERNAL COMBUSTION ENGINES, AND PROCESS FOR PRODUCING AN UNFINISHED CYLINDER HEAD CASTING

CROSS-REFERENCE TO RELATED APPLICATIONS

This application is a National Phase Application of International Application No. PCT/EP2006/064363, filed on Jul. 18, 2006, which claims the benefit of and priority to German patent application no. DE 10 2005 037 735.1-13, filed Aug. 5, 2005, which is owned by the assignee of the instant application. The disclosure of each of the above applications is incorporated herein by reference in their entirety.

TECHNICAL FIELD

The invention relates to an unfinished cylinder head casting for producing a cylinder head for internal combustion engines powered with diesel fuel, having a sealing surface intended for mounting in the finished state on a corresponding sealing surface of an engine block, and designed on a sealing surface section of the unfinished cylinder head casting, the thickness of the section in the casting state exhibiting a machining allowance in relation to its set thickness, obtained after a material-removing finishing of the sealing surface, the sealing surface further including a combustion chamber region, associated with a combustion chamber formed in the engine block.

Moreover the invention relates to a cylinder head, cast from a metal melt, for internal combustion engines powered with diesel fuel, having a sealing surface intended for mounting on a corresponding sealing surface of an engine block, obtained by material-removing finishing, including a combustion chamber region, which is associated with a combustion chamber formed in the engine block.

Finally the invention also relates to a process for casting an unfinished cylinder head casting, wherein a metal melt, in particular a light alloy melt, is casted into a mould, which for reproducing the unfinished cylinder head casting comprises a mould cavity, which has a periphery reproducing a sealing surface on said unfinished cylinder head casting, and wherein after casting, solidification and demoulding of the unfinished cylinder head casting, the sealing surface is finished through machining, by removing casting material over a thickness in the region of the sealing surface, in order to produce a finished sealing surface for mounting on a corresponding sealing surface of an engine block.

BACKGROUND

In the case of cylinder heads for internal combustion engines powered with diesel fuel, particularly in the case of direct fuel injection engines, the combustion chamber region does not have dome-shaped geometry, as is usually the case with cylinder heads for petrol engines, but is incorporated evenly into the equally flat sealing surface, by which the diesel cylinder head rests in the installed state against the sealing surface, associated therewith, of the respective engine block. The combustion chamber region of the cylinder head in this way lies in the sealing plane of the engine block.

In order to be able to produce the sealing surface with the precision necessary for a permanently assured tight seat, in the case of the unfinished cylinder head casting, a machining allowance, which is removed during finishing of the cylinder head, is usually pre-cast. In practice the additional thickness of the section, carrying the sealing surface, of the unfinished cylinder head casting, provided as machining allowance and removed in the course of finishing usually amounts to 2 mm-3 mm. The mechanical removal of this thickness enables the sealing surface to be produced with extreme precision and the necessary evenness.

In service the combustion chamber region of the cylinder head is loaded to the maximum due to the high pressures and high temperatures arising in the case of diesel engines. This load, in particular with cylinder heads cast from light metallic alloys, on the valve seats and valve crosspieces usually incorporated in their combustion chamber regions, leads to increased crack susceptibility. This susceptibility is particularly problematic under consideration of the desire for cylinder heads with even higher load-bearing capacity, which on the part of the manufacturers and users of diesel engines is greater in view of the requirement for as much power output as possible.

Just at the time when the cylinder heads are to be made of a light alloy material, for example an aluminum alloy, these demands have only been able to be met till now with substantial technical effort as regards the alloy, design or production. Thus the load-bearing capacity of the valve seats in the region of the combustion chamber can be improved for example by incorporating elements made of metal with higher load-bearing capacity in the casting. The effort linked with incorporating the valve seats in the casting and the measures necessary for their sufficiently solid integration in the light alloy of the cylinder head however entails additional production costs. The same applies to the possibility of increasing the strength and elongation properties of the combustion chamber region by additional heat treatment.

SUMMARY OF THE INVENTION

In one aspect, the invention is directed to create an unfinished cylinder head casting, capable of being produced in a simple way, from which a cylinder head for diesel engines with optimum load-bearing capacity can be manufactured in a simple manner. Likewise a cylinder head for diesel engines produced accordingly, in particular cast from a light metallic alloy followed by machining is to be indicated, which also permanently satisfies the increased demands for optimum load-bearing capacity of such cylinder heads. Finally the invention is also aimed at providing a suitable process for producing such cylinder heads.

In another aspect, an embodiment features an unfinished cylinder head casting of the type described initially, with such unfinished castings, and has a machining allowance of the sealing surface section in the combustion chamber region of the sealing surface that amounts to a maximum of 15% of the oversize of the sealing surface section in the remaining region of the sealing surface.

The invention is based on the recognition that the static and dynamic characteristics of the combustion chamber region, included by the sealing surface of the cylinder head to be produced, are considerably affected by the configuration of the cast structure. Special significance in this case is attributed to the structural quality substantially dependent on the solidification rate.

During casting of the light alloy melt, solidification is controlled by heat extraction via the mould and is quickest at the contact area between the mould and the melt casted into the mould. As the invention proposes limiting the thickness of the machining allowance in the combustion chamber region to a minimum, it has now been achieved that the quickly solidified cast structure adjacent to the surface in the combustion chamber region, also after the material-removing finishing, which is unavoidable for producing the necessary evenness of the sealing surface, is not removed but remains intact on the surface of the combustion chamber region. The mechanical characteristics are correspondingly good there, compared with the more slowly solidified strata of the cast cylinder head lying further inside. The combustion chamber region thus contains the best-solidified structure and therefore has a higher load-bearing capacity over a longer service life.

In another aspect, an embodiment of the invention features a cylinder head that exhibits a cast structure, which corresponds to the cast structure in the combustion chamber region adjacent to its surface, which is present in the region of the sealing surface, adjacent to the surface before its material-removing finishing.

In another aspect, an embodiment of the invention is directed to a process in which the periphery of the mould comprises an elevation, which forms a combustion chamber region in the sealing surface of the unfinished cylinder head casting, wherein the elevation has a surface extending substantially parallel to the periphery, which is arranged at a distance from the sealing surface, amounting to at least 85% of the thickness of the material removed in the course of the material-removing finishing of the sealing surface.

It is common to the various embodiments of the invention that the combustion chamber region formed in the sealing surface of the cylinder head is already produced when casting the cylinder head so near to final dimension that only a minimum amount of material is removed at most in the combustion chamber region during the material-removing finishing of the sealing surface, which after casting is unavoidable for producing its evenness. In this way a quickly solidified cast structure of fine texture remains in the combustion chamber region, included by the sealing surface, of the finished cylinder head.

Practical investigations have shown that the cylinder heads designed and produced according to the invention, in their respective combustion chamber region, have tensile strengths, which are greater by 5% to 15% than the tensile strengths of conventionally designed and machined cylinder heads produced from the same cast alloys. Also these investigations have shown ductility of the inventive cylinder heads increased by 15%-25%, compared to conventional cylinder heads.

The characteristic improvements achieved according to the invention can be further optimized by minimizing the machining allowance in the combustion chamber region of the sealing surface. Accordingly advantageous configurations of the invention propose limiting the machining allowance in the combustion chamber region to a maximum of 10%, in particular 7% and even more preferably to a maximum of 4% of the oversize of the sealing surface section in the remaining region of the sealing surface. Thus in the case of an unfinished cylinder head casting configured according to the invention, the oversize of the thickness in the combustion chamber region for example lies between 0.1 mm and 0.2 mm, while in the remaining sealing surface, including the combustion chamber region it can in a conventional way continue to be 2 mm-3 mm.

BRIEF DESCRIPTION OF THE DRAWINGS

The invention is described in detail below on the basis of a drawing illustrating an exemplary embodiment, in each case there being shown schematically.

DESCRIPTION

Figure 1:
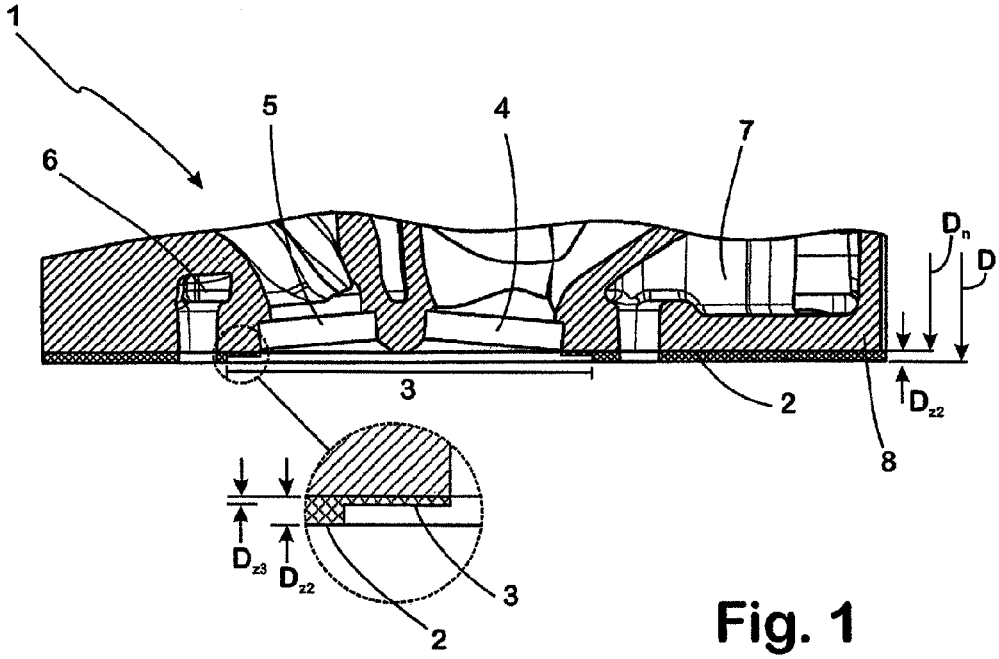
FIG. 1 a cutout in cross section of an unfinished cylinder head casting, cast out of a conventional aluminum cast alloy.
Figure 2:
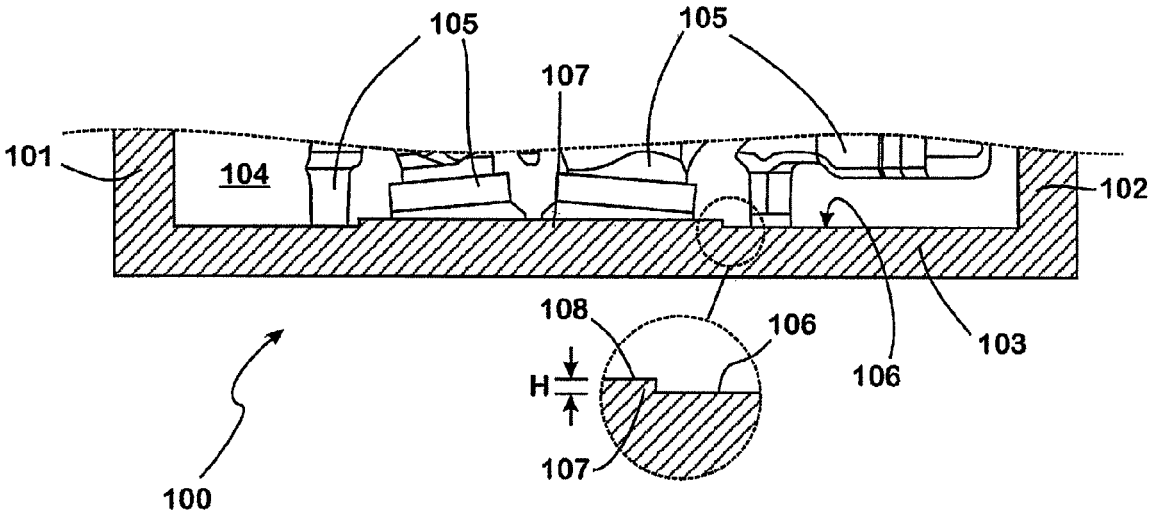
FIG. 2 a cutout in cross section of a mould for casting the unfinished cylinder head casting, illustrated in FIG. 1.

The unfinished cylinder head casting 1 on its lower side, in the assembled condition, has a sealing surface 2, which extends over the entire width and length of the unfinished cylinder head casting 1. The sealing surface 2 is formed substantially evenly already in the unfinished casting raw state illustrated in FIG. 1.

The sealing surface 2 includes a combustion chamber region 3, which is associated with a combustion chamber of an engine block, not illustrated here. A valve seat 4 for an inlet valve, not illustrated, and a valve seat 5 for an exhaust valve, also not illustrated, are formed in the combustion chamber region 3. Additionally cooling passages 6, 7 are formed in the unfinished cylinder head casting 1, the connection port of which for joining to corresponding passages of the engine block opens out in the sealing surface 2 at a distance from the combustion chamber region 3.

The sealing surface 2 is carried with the combustion chamber region by a sealing surface section 8 extending over the width and length of the unfinished cylinder head casting 1. This sealing surface section 8 arranged in the area between the sections, running parallel to the sealing surface 2, of the cooling passages 6, 7, said sealing surface 2 is also described in technical parlance as "combustion chamber deck".

Figure 3:
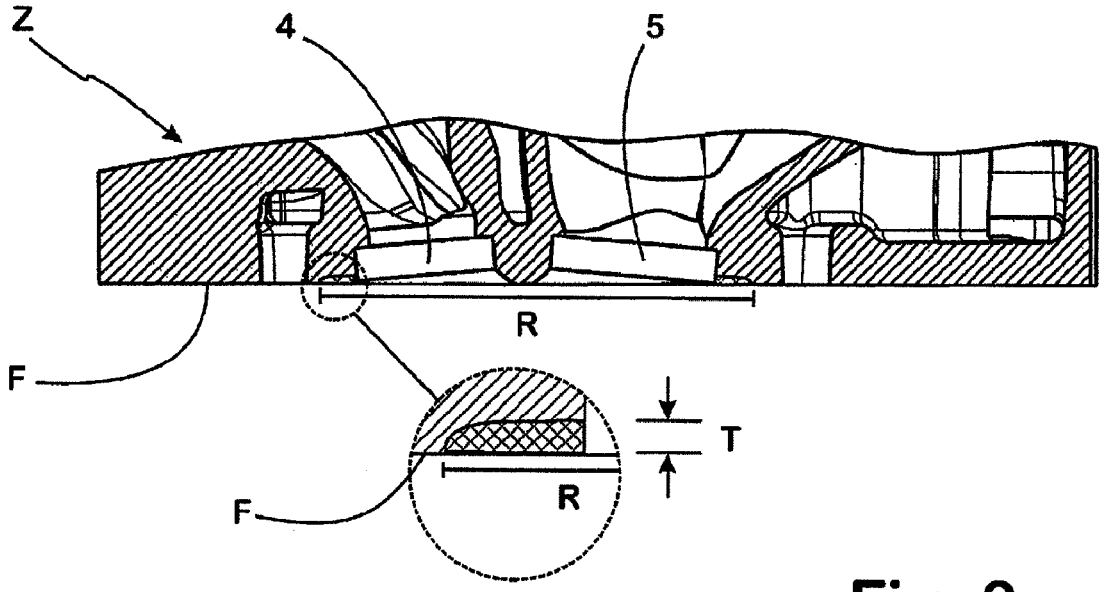
FIG. 3 a cutout in cross section of a cylinder head finished from the unfinished cylinder head casting shown in FIG. 1.

In the region of the sealing surface 2 the thickness D of the sealing surface section 8 in the casting raw state is thicker by a machining allowance $D_{Z2}$ than the set thickness $D_n$ of the sealing surface section 8 in the finished state illustrated in FIG. 3. In practice the machining allowance $D_{Z2}$ amounts to 2 mm for example.

In contrast to the region of the sealing surface 2 the sealing surface section 8 in the combustion chamber region 3 is only slightly thicker than the prescribed set thickness $D_n$ in the finished state. Thus the machining allowance $D_{Z3}$ in the combustion chamber region amounts to only 0.1 mm, that is to say 5% of the machining allowance $D_{Z2}$ in the case of the unfinished cylinder head casting 1.

In consequence of the minimized thickness of the machining allowance $D_{Z3}$ the unfinished cylinder head casting 1 in the combustion chamber region 3 has, on the basis of its free surface, a fine cast structure throughout a depth T, due to the quickly progressed solidification, which extends up into the region of the set thickness $D_n$ of the finished cylinder head Z. In the region of the sealing surface 2 however only a relatively coarse structure is present in the region of the set thickness $D_n$, since due to the distance from the free surface of the sealing surface 2, which is greater as a result of the larger machining allowance $D_{Z2}$, the aluminum casting material is solidified more slowly there than in the strata near the surface.

For casting the unfinished cylinder head casting 1 a mould 100 is provided, which with its sidewalls 101, 102 and its base 103 encompasses a mould cavity (104). Casting cores 105 in this case serve to reproduce the valve seats 4, 5 and the cooling passages 6 or 7 of the unfinished cylinder head casting 1.

In order on the one hand to produce the sealing surface 2 and on the other hand the combustion chamber region 3 formed in the sealing surface 2 of the unfinished cylinder head casting 1, a flat periphery 106 associated with the mould cavity 104, is formed on the base 103 of the mould 100. In its section associated with the combustion chamber region 3 of the unfinished cylinder head casting, this has an elevation 107, the outer contour of which corresponds to the shape of the combustion chamber region 3. The elevation 107 in this case has on its free upper side a flat surface 108, which is aligned parallel to the periphery 106. The height H, at which the surface 108 is arranged above the periphery 106, in this case amounts to 95% of the machining allowance $D_{Z2}$ to be cast in the region of the sealing surface 2 onto the unfinished cylinder head casting 1, therefore 1.9 mm in the present case.

During finishing of the unfinished cylinder head casting 1 the thick machining allowance $D_{Z2}$ in the region of the sealing surface 2 and the machining allowance $D_{Z3}$ in the combustion chamber region 3 are removed by material-removal, so that an even sealing surface F, which changes seamlessly into the equally flat combustion chamber region R included thereby, is formed on the finished cylinder head Z. The amount of material removed in the region of the sealing surface 2 in this case is so great that only the relatively coarse cast structure is present on the free face of the finished sealing surface F. In contrast the fine cast structure resulting from the quick solidification adjacent to the surface is still present in the combustion chamber region R of the finished cylinder head Z, due to the very much reduced amount of material removed there. This ensures that increased strength and improved elongation values are present in the combustion chamber region R of the finished cylinder head Z.

After mounting the finished cylinder head Z on the sealing surfaces, associated therewith, of the engine block, not shown here, the combustion chamber region R and the sealing surface F encompassing it, of the cylinder head Z lie in the same sealing plane. The combustion chamber region R in this case covers the combustion chamber, associated therewith, of the engine block.

REFERENCE SYMBOLS

1 unfinished cylinder head casting
2 sealing surface of the unfinished cylinder head casting
3 combustion chamber region
4, 5 valve seats
6, 7 cooling passages
8 sealing surface section of the unfinished cylinder head casting 1
100 mould
101, 102 sidewalls
103 base of the mould 100
104 mould cavity
105 casting cores
106 periphery
107 elevation
108 surface of the elevation 107
D thickness of the sealing surface section 8
$D_n$ set thickness of the sealing surface section 8 in the finished state
$D_{Z2}$ machining allowance
$D_{Z3}$ machining allowance in the combustion chamber region 3
H height, at which the surface 107 is arranged above the periphery 106
F sealing surface of the cylinder head Z
R combustion chamber region of the cylinder head Z
T depth, throughout which a fine, quickly solidified structure is present
Z finished cylinder head

The invention claimed is:

1. Unfinished cylinder head casting for producing a cylinder head for internal combustion engines powered with diesel fuel, the unfinished cylinder head casting comprising:

a sealing surface for mounting the unfinished cylinder head casting in a finished state on a corresponding sealing surface of an engine block, the sealing surface including a combustion chamber region, the combustion chamber region associated with a combustion chamber formed in the engine block; and a sealing surface section, the sealing surface being positioned on the sealing surface section of the unfinished cylinder head casting, the sealing surface section having a thickness in a casting state including a first machining allowance in relation to a set thickness obtained after a material-removing finishing of the sealing surface, wherein within at least a portion of the combustion chamber region a second machining allowance of the sealing surface section amounts to a maximum of 15% of the first machining allowance of the sealing surface section.

2. Unfinished cylinder head casting according to claim 1, wherein the second machining allowance amounts to a maximum of 10% of the first machining allowance of the sealing surface section.

3. Unfinished cylinder head casting according to claim 1, wherein the second machining allowance amounts to a maximum of 7% of the first machining allowance of the sealing surface section.

4. Unfinished cylinder head casting according to claim 1, the second machining allowance amounts to a maximum of 4% of the first machining allowance of the sealing surface section.

5. Unfinished cylinder head casting according to claim 1, wherein the sealing surface and the combustion chamber region are formed substantially evenly.

6. Unfinished cylinder head casting according to claim 1, wherein at least one valve seat is formed in the combustion chamber region.

7. Unfinished cylinder head casting according to claim 1, wherein the cylinder head casting is cast from a light metallic alloy.

* * * * *